US006814571B2

(12) United States Patent
Nyberg et al.

(10) Patent No.: US 6,814,571 B2
(45) Date of Patent: Nov. 9, 2004

(54) ARRANGEMENT AND METHOD FOR REDUCING BUILD-UP ON A ROASTING FURNACE GRATE

(75) Inventors: Jens Nyberg, Matruusinkatu (FI); Heikki Siirilä , Parkki (FI); Juha Järvi, Kaunokkitie (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/471,194

(22) PCT Filed: Mar. 8, 2002

(86) PCT No.: PCT/FI02/00180

§ 371 (c)(1),
(2), (4) Date: Sep. 9, 2003

(87) PCT Pub. No.: WO02/072894

PCT Pub. Date: Sep. 19, 2002

(65) Prior Publication Data

US 2004/0086820 A1 May 6, 2004

(30) Foreign Application Priority Data

Mar. 9, 2001 (FI) ..... 20010474

(51) Int. Cl.[7] ..... F23H 11/10
(52) U.S. Cl. ..... 432/77; 110/270
(58) Field of Search ..... 432/77, 58, 200, 432/201; 110/270, 273, 300

(56) References Cited

U.S. PATENT DOCUMENTS

| | | | | |
|---|---|---|---|---|
| 2,825,628 A | | 3/1958 | Johannsen et al. | 23/177 |
| 2,930,687 A | | 3/1960 | Thornhill et al. | 75/9 |
| 4,323,037 A | | 4/1982 | Meyer-Kahrweg | 122/4 D |
| 4,341,515 A | | 7/1982 | Korenberg | 432/15 |
| 4,683,305 A | | 7/1987 | Fuchs et al. | 540/533 |
| 4,762,489 A | * | 8/1988 | Schmits et al. | 432/77 |
| 4,876,972 A | * | 10/1989 | Mrklas | 110/298 |
| 5,584,686 A | * | 12/1996 | Nielsen | 432/77 |
| 5,895,213 A | * | 4/1999 | Sutoh et al. | 432/77 |
| 6,641,392 B2 | * | 11/2003 | Siirila | 432/58 |

FOREIGN PATENT DOCUMENTS

| | | | |
|---|---|---|---|
| DE | 42 11 646 A 1 | 10/1993 | B01J/8/44 |
| EP | 0 844 920 B1 | 4/2003 | B24B/31/00 |

OTHER PUBLICATIONS

WPI Derwent's Abstract of SU 663963 A, published on May 25, 1979, Accession No. 1980–B3596C.

* cited by examiner

*Primary Examiner*—Gregory Wilson
(74) *Attorney, Agent, or Firm*—Morgan & Finnegan, L.L.P.

(57) ABSTRACT

The present invention relates to an arrangement and method that help to reduce the build-up formed on the grate of a fluidized-bed furnace in the roasting of fine-grained material such as concentrate. The concentrate is fed into the roaster furnace from the wall of the furnace, and oxygen-containing gas is fed via gas jets under the grate in the bottom of the furnace in order to fluidize the concentrate and oxidize it during fluidization. Below the concentrate feed point, or feed grate, the oxygen content of the gas to be fed is raised compared with gas fed elsewhere using additional gas jets situated in the feed grate higher than the other jets. The extra jets of the feed grate are connected to their own gas distribution unit.

9 Claims, No Drawings

ARRANGEMENT AND METHOD FOR REDUCING BUILD-UP ON A ROASTING FURNACE GRATE

BACKGROUND OF THE INVENTION

The present invention relates to an arrangement and a method to reduce the build-up formed on the grate of a fluidized-bed furnace in the roasting of fine-grained material such a concentrate.

1. Field of the Invention

The concentrate is fed into the roaster from the wall of the furnace, and oxygen-containing gas is fed via gas nozzles under the grate in the bottom of the furnace in order to fluidize the concentrate and oxidize it during fluidization. Below the concentrate feed point, or feed grate, the oxygen content of the gas to be fed is raised compared with gas fed elsewhere with additional gas jets situated higher in the feed grate than the other jets. The extra jets of the feed grate are connected to their own gas distribution unit.

2. Description of the Related Art

The roasting of fine-grained material such as zinc concentrate usually takes place using the fluidized bed method. The material to be roasted is fed into the roasting furnace via feed units in the wall of the furnace above the fluidized bed. On the bottom of the furnace there is a grate, via which oxygen-containing gas is fed in order to fluidize the concentrate. There are usually in the order of 100 gas jets/m2 under the grate. As the concentrate becomes fluidized, the height of the feed bed rises to about half that of the fixed material bed.

The concentrate in the fluidized bed is oxidized (burnt) to a calcine by the effect of the oxygen-containing gas fed via the grate, e.g. zinc sulfide concentrate is roasted into zinc oxide. In zinc concentrate roasting the temperature to be used is in the region of 900–1050° C. The calcine is partially removed from the furnace through the overflow aperture, and partially it travels with the gases to the waste heat boiler and from there on to the cyclone and electrostatic precipitators, where the calcine is recovered. In general the overflow aperture is located on the opposite side of the furnace to the feed units. The calcine removed from the furnace is cooled and ground finely for leaching.

For good roasting it is important to control the bed i.e. the bed should be good and the fluidizing controlled. Combustion should be as complete as possible, i.e. the sulfides should be oxidized into oxides. The calcine should also come out of the furnace well. The particle size of the calcine is known to be affected by the chemical composition and mineralogy of the concentrate as well as by the temperature of the roasting gas.

In the technique currently in use the roaster concentrate feed is regulated according to the temperature of the bed using for example fuzzy logic. Thus there is a danger that the amount of oxygen in the roasting gas may drop too low i.e. that the amount of oxygen is insufficient to roast the concentrate. At the same time the back pressure of the bed may fall too low.

It is known from balance calculations and balance diagrams in the literature that copper and iron together form oxysulfides, which are molten at roasting temperatures and even at lower temperatures. Similarly, zinc and lead as well as iron and lead together form sulfides molten at low temperatures. This kind of appearance of sulfides is possible and the likelihood grows if the amount of oxygen in the bed is smaller than that normally required to oxidize the concentrate.

During fluidized bed roasting agglomeration of the product normally occurs, i.e. the calcine is clearly coarser than the concentrate feed. The above-mentioned formation of molten sulfides however increases agglomeration to a disturbing degree, in that the larger agglomerates with their sulfide nuclei remain moving around the grate. The agglomerates cause build-ups on the grate and with time block the gas jets under the grate. It has been noticed in zinc roasters that build-ups containing impure components are formed in the furnace particularly in the section of the grate under the concentrate feed units.

In the prior art, for example in DE application publication 42 11 646, a gas feed arrangement for a fluidized bed has been described. It was stated to be a problem that the material to be fluidized tends to settle back into the furnace at the edges of the furnace and particularly back to the solids feed point, such as for instance a build-up tending to form on the furnace grate under the feed point of material returning to the cycle. In order to avoid build-ups, the gas jets, particularly in that part of the grate where the bed material is returned, and at the edges of the furnace, are to be raised higher than the jets in the central part (longer nozzle arm head). The purpose is that the nozzles are at the same distance from the bottom or the solids at all points in the furnace. Some of the jets in the furnace may be raised higher than others, also in the central part of the grate, in order to prevent build-ups. The jets blow the gas to the side or down. All the jets are connected to the same gas distribution unit i.e. the gas feed is uniform.

When a great deal of impure, highly reactive concentrate is fed to a roasting furnace, an oxygen deficit is caused in the immediate vicinity of the feed unit preventing the oxidation of the concentrates to oxides, i.e. the actual purpose of roasting. As a result, a molten sulfidic material of low temperatures is formed, which agglomerates. The larger agglomerates sink to the grate, remain there rotating and combine to form a layer of build-up, which blocks the gas jets.

BRIEF SUMMARY OF THE INVENTION

The objective of the arrangement developed now is to reduce and remove the build-up formed on the fluidized bed grate in the roasting of fine-grained material by increasing the feed of gas using extra gas jets situated above the grate, particularly in that part of the roasting furnace into which the material is fed. The extra jets belong to a separate gas feed line, so the amount of gas in them and at the same time their solids mixing efficiency can be adjusted. The invention also relates to a method for reducing build-ups in the roasting of fine-grained material in a fluidized-bed furnace, where the material to be roasted is fed into the furnace through a feed connection in the wall of the roasting furnace, and fluidized by roasting gas blown through the grate in the bottom of the furnace. At least some of the roasted material is removed via the overflow aperture at the height of the top of the fluidized bed as the gases and some of the solids exit the upper section of the furnace. The section of the grate below the feed point of the fine-grained material is equipped with additional gas jets, which are connected to a separate gas feed line, and roasting gas is fed into the furnace via the additional gas jets with an oxygen content which is equal to or higher than the oxygen content of the fluidizing gas in the rest of the grate. The essential features of the invention are made apparent in the attached claims.

The build-up formed on the grate below the roaster feed units is reduced according to the invention by changing the conventional grate construction, whereby the gas feed to the whole cross-section of the grate occurs uniformly and where the same amount of gas is fed to every part of the grate. Using the equipment now developed, the gas feed to that part of the grate located below the feed units, known as the feed grate, is increased compared with the gas feed to the rest of the grate. The gas feed increase takes place by placing extra jets above the normal level of a feed grate jet. The jets are directed so that the passage of the solids is guided away from the solids feed area. The jets are preferably multi-branched, so that the nozzle at the end of the nozzle tube extending above the grate level opens out essentially horizontally in several, for instance three directions.

A horizontal gas feed helps to make the fresh solid material fed into the furnace spread and mix into the bed well. In addition a greater amount of gas is obtained in the area, which promotes the fluidizing of large particles and removes the local oxygen deficit. The number of extra gas jets at the gas feed point is at least 5%, preferably 10–20% of the normal number of grate jets in a feed grate. The same gas can be fed via the extra jets as via the main grate jets, or gas richer in oxygen can be fed via the extra jets than to the rest of the grate. The feed grate constitutes at least 5% of the total roasting furnace grate, preferably 10–15%. The intention is to spread the material fed into the furnace over a wider area with the aid of the extra gas jets i.e. across the whole cross-section of the furnace. This is achieved using additional gas jets directed substantially horizontally.

What is claimed is:

1. An arrangement to reduce build-up in a roasting of fine-grained material in a fluidized bed furnace, said arrangement comprising a gas distribution unit situated in the lower part of the furnace, connected to a plurality of primary jets, via which gas is fed through the bottom of the grate into the fluidized bed space, into which fine-grained solid material is fed via a feed unit located in a furnace wall and made to fluidize, said furnace wall being equipped with an overflow aperture for calcined material and with a discharge aperture located in the upper part of the furnace, the part of the grate beneath the fine-grained material feed point being equipped with a plurality of secondary gas jets, which are connected to a separate gas feed line and the number of secondary jets at the feed grate point being at least 5% of the number of primary gas jets in the feed grate area.

2. An arrangement according to claim 1, wherein the percentage of the grate beneath the concentrate feed point, is at least 5% of the total cross-sectional area of the grate.

3. An arrangement according to claim 1, wherein the percentage of the grate beneath the concentrate feed point, is 10–15% of the total cross-sectional area of the grate.

4. An arrangement according to claim 1, wherein the number of secondary gas jets at the feed grate point is 10–20% of the number of primary gas jets in the feed grate area.

5. An arrangement according to claim 1, wherein the plurality of secondary gas jets are located above the grate level.

6. An arrangement according to claim 1, wherein the plurality of secondary gas jets are directed horizontally.

7. An arrangement according to claim 1, wherein the plurality of secondary gas jets are multi-branched so that the nozzle at the end of the nozzle tube extending above the grate level opens out essentially horizontally in several directions.

8. A method for reducing build-up in a roasting of fine-grained material in a fluidized bed furnace, comprising feeding the material to be roasted into the fluidized bed space via a feed unit located in a furnace wall and fluiding the feed material by roasting gas blown through a grate in the bottom of the furnace, removing at least some of the calcined material via an overflow aperture at the height of the top of the fluidized bed as the gases and some of the solids exit the upper section of the furnace, equipping the section of the grate below the feed point of the fine-grained material with a plurality of secondary gas jets, their amount being at least 5% of the number of primary gas jets in the feed grate area, connecting the plurality of secondary jets to a separate gas feed line, and feeding roasting gas into the furnace via the plurality of secondary gas jets with an oxygen content which is at least equal to the oxygen content of the roasting gas in the rest of the grate.

9. A method according to claim 8, further comprising feeding roasting gas into the furnace via the plurality of secondary gas jets with an oxygen content which is higher than the oxygen content of the roasting gas in the rest of the grate.

* * * * *